US006468105B2

(12) United States Patent
Noguchi et al.

(10) Patent No.: US 6,468,105 B2
(45) Date of Patent: Oct. 22, 2002

(54) CONNECTOR

(75) Inventors: Hirotaka Noguchi; Kenji Inoue, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/957,210

(22) Filed: Sep. 19, 2001

(65) Prior Publication Data

US 2002/0052135 A1 May 2, 2002

(30) Foreign Application Priority Data

Oct. 31, 2000 (JP) ..... 2000-333366

(51) Int. Cl.[7] ..... H01R 3/00
(52) U.S. Cl. ..... 439/489; 439/352
(58) Field of Search ..... 439/489, 352, 439/488, 353, 350, 354, 355, 356, 357, 358

(56) References Cited

U.S. PATENT DOCUMENTS 6,109,955 A * 8/2000 Hanazaki et al. ..... 439/489
6,234,826 B1 * 5/2001 Wilber et al. ..... 439/352

FOREIGN PATENT DOCUMENTS

JP 1-166977 6/1989

* cited by examiner

*Primary Examiner*—P. Austin Bradley
*Assistant Examiner*—Alexander Gilman
(74) *Attorney, Agent, or Firm*—Anthony J. Casella; Gerald E. Hespos

(57) ABSTRACT

A lock arm (25) and two preventive walls (32) are provided on the upper face of the female housing (20), and a detecting member (40) is mounted between both preventing walls (32) from the back. Two engaging arms (51) are provided on the detector (40). The engaging faces (53) at the front end of the detecting member (25) are engaged with an engaging protrusive area (37) that project from the preventing wall (32). The detector ( ) is stopped in advance at the standby position. Inside the hood (11) of male housing (10), a pair of releasing ribs (60) are provided, and the upper face extending along an interfitting direction of both housings (10) and (20) is connected with the ceiling area of hood (11).

11 Claims, 18 Drawing Sheets

CONNECTOR

BACKGROUND OF THE INVENTION

1. Field of the Invention

The present invention relates to a connector with mating connector housings equipped with a detector for detecting an interfitting condition of the connector housings.

2. Description of the Related Art

A conventional connector that is equipped with a detecting member for detecting an interfitting condition of male/female connector housings is described in Japanese Unexamined Utility Model Publication No. (Hei)1-166977, and also is shown in FIG. 17 herein. This known connector includes a male housing 1 and a female housing 2. The male housing 1 has a lock area 3, and the female housing 2 is equipped with a lock arm 4 can be engaged with the lock area 3 on the male housing 1 so that the housings 1 and 2 can be mutually interfitted. The female housing 2 also has a pair of engaging arms 5 that can be crimped into engagement with the lock arm 4 from the right and left. Additionally, a detecting member 6 is mounted from the back of the female housing 2, and is movable back and forth along the lock arm 4. Engaging protrusions 7 are provided on the left and right side faces of the lock arm 4, as shown in FIG. 18. The protrusions 7 are disposed to strike against the tip of the engaging arm 5 to control the forward movement of the detecting member 6 before interfitting. The lock arm 4 also is formed with engaging areas that protrude from the left and the right of the lock arm 4.

The lock arm deflects during the interfitting of the housings 1 and 2, and as a result, the engaging areas 8 are displaced to a position that allows interference with the detecting member 6. Hence, forward movement of the detecting member 6 during the course of interfitting is regulated. On the other hand, a releasing arm 9 protrudes from the male housing 1, as shown in FIG. 17. The releasing arm 9 engages in the engaging arm 5 on the female housing 2 during the interfitting of the housings 1 and 2. The releasing arm 9 then is deflected and the abutted condition against the engaging protrusion 7 of engaging arm 5 is released. When the housings 1 and 2 reach a normal interfitting state, the engaging area 8 of returned lock arm 4 is disposed in a non-interfering position with the detecting member 6, and then further movement of detecting member 6 is permitted.

Movement of the detecting member 6 is released only when both of the housings 1 and 2 are interfitted properly. Thus, detection of whether or not the both housings 1 and 2 have come to a normal interfitting condition can be achieved by checking the movement of the detecting member 6.

The base end of the releasing arm 9 is connected with the bottom end face of the recess in the male housing 1 and the free end is cantilevered forward along an interfitting direction. Accordingly, there is a problem of strength. For instance, a foreign object may enter into the male housing 1 before the male and female housings 1 and 2 interfit properly. The foreign object may interfere with the releasing arm 9. As a result, there has been a possible malfunction, such as deformation of the releasing arm 9 or, as this case may be, any other occurrence of damage.

The present invention has been made in view of the aforementioned circumstances, with the objective for enhancing the strength of the releasing area.

SUMMARY OF THE INVENTION

The invention is directed to a connector comprising first and second connector housings that are mutually interfittable A lock arm is provided on the first connector housing and allows an elastic deformation in a deflective space when both connector housings are in the process of interfitting. However, the lock arm will undergo an elastic return for engaging with the second connector housing to maintain the interfitting condition of the connector housings when the connector housings came to a normal or complete interfitting condition. More particularly, the lock arm will move between a standby position that is withdrawn from the deflective space and a detecting position where the lock arm enters into the deflective space.

A detector is mounted for restraining the movable action of the lock arm into the deflective space in the course of interfitting. The detector comprises at least one deflective engaging arm that restrains movement of the detector from a standby position to a detecting position at least in a condition when the connector housings are separated. More particularly, the deflective engaging arm functions by engaging an engaging area on the first connector housing. At least one releasing area is provided on the second connector housing and extends along the interfitting direction of the connector housings. The releasing area deflectively deforms the engaging arm to release the engaging condition of the engaging area with the engaging arm. The releasing area is connected with a wall face of the second connector housing along the interfitting direction.

The connector may comprise a pair of the engaging arms, a pair of the engaging areas, and a pair of the releasing areas.

The engaging arms, the engaging areas and the releasing areas are disposed to provide a time difference in which the engaging arms are released from the respective engaging areas in an interfitting process of the connector housings. The time difference is achieved by having engaging faces of the respective releasing areas or the engaging arms displaced along the interfitting direction.

The second connector housing may include a guiding rib that allows an interfitting action to be guided in sliding contact with the first connector housing during the interfitting of the connector housings. The guiding rib extends along the interfitting direction, and the releasing area is connected with the guiding rib along the interfitting direction.

The detector may be mounted at a standby position with the first and second connector housings spaced apart. In this position, the engaging arm engages with the engaging area. Thus, movement of the detector from the standby position to the detecting position is regulated. The connector housings then can be advanced toward an interfitted condition. This movement causes the lock arm to deform elastically and to deflect into the deflective space for regulating movement of the detector to the detecting position. When both connector housings come to a normal and complete interfitting condition, the lock arm returns and then the deflective space is released. Until this time an interval with the releasing area engages and then deflects the engaging arm. The engaging condition with the engaging area has been released. Thus, the detector can be moved to the detecting position. In this way, the status of movement of detector allows the interfitted condition of both connector housings to be detected.

The released area is connected along an interfitted direction to the wall face of second connector housing. Thus, the strength can also be made higher.

The engaging arms and the engaging areas may be staggered or offset longitudinally to achieve contact at different times during the interfitting process. In such a way, the timing can be shifted to reduce the power necessary for deflecting the engaging arm in the course of interfitting the connector housings. Accordingly, an abrupt increase in interfitting power can be prevented, thereby leading to a smooth interfitting operation, compared with the case of simultaneous release of both engaging arms.

Connection of the releasing area is made along the interfitting direction of guiding rib. Therefore, the strength of releasing area can further be enhanced.

DETAILED DESCRIPTION OF THE PREFERRED EMBODIMENT

Figure 1:
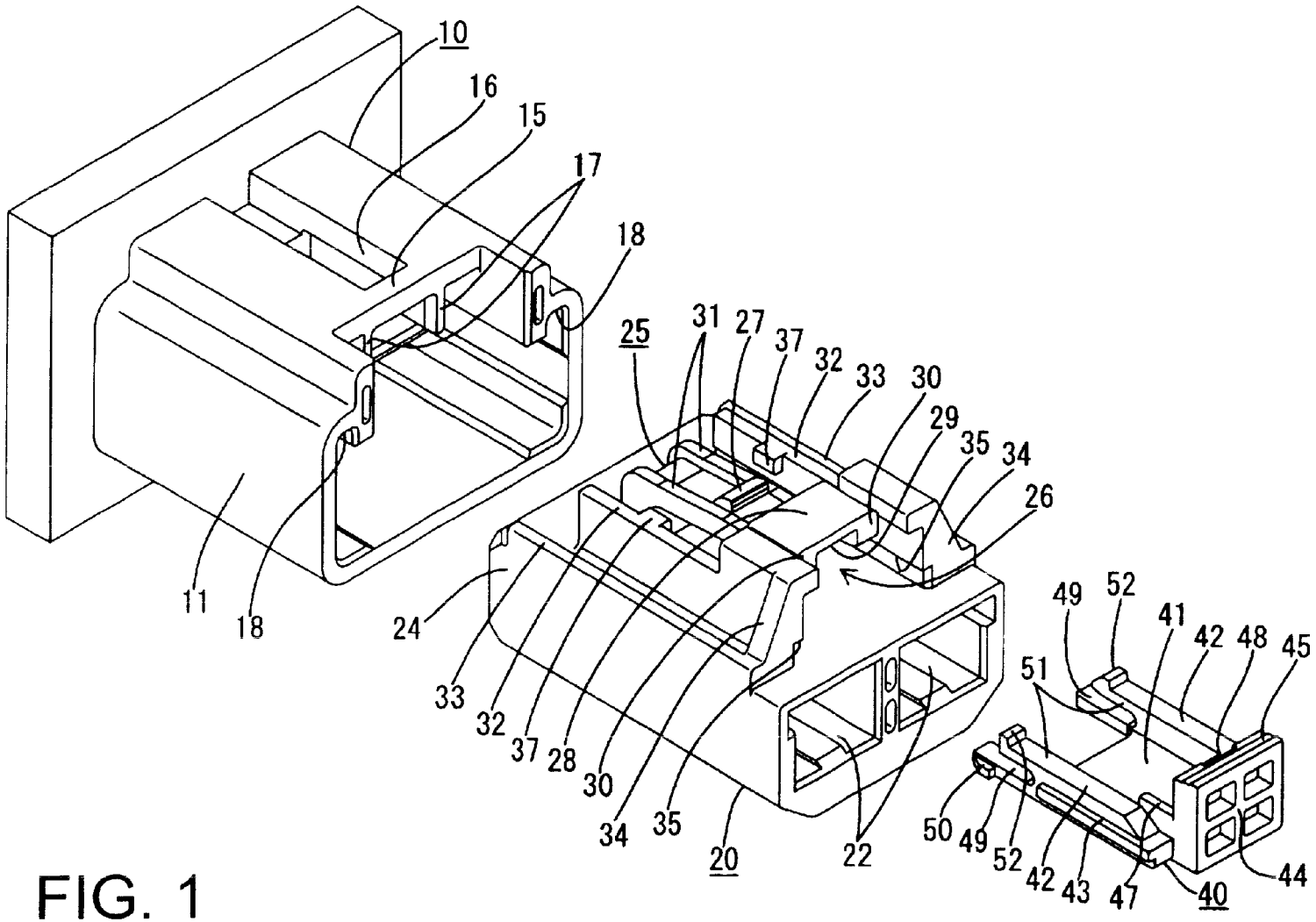
FIG. 1 is an exploded perspective view showing a connector with regard to one embodiment of the present invention.

The connector of the present embodiment includes a female connector housing 20 with a unitary lock arm 25, as shown in FIG. 1. The female housing 20 is interfitted to a male connector housing 10, and a detector 40 is mounted onto the female housing 20. In the description that follows, the sides at which the housings 10 and 20 interfit with one another will be considered the "forward" side.

Figure 3:
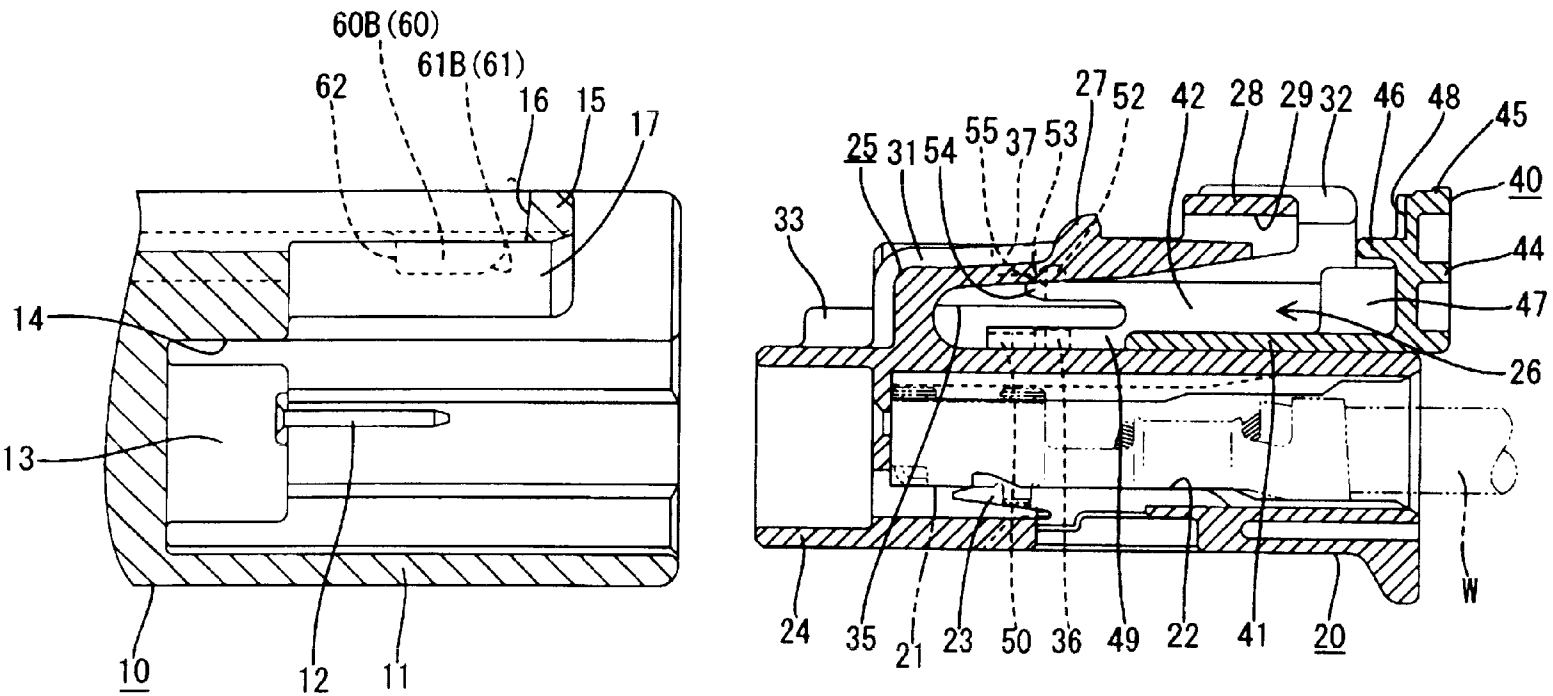
FIG. 3 is a sectional side view showing a condition in which both housings are separated from each other.
Figure 4:
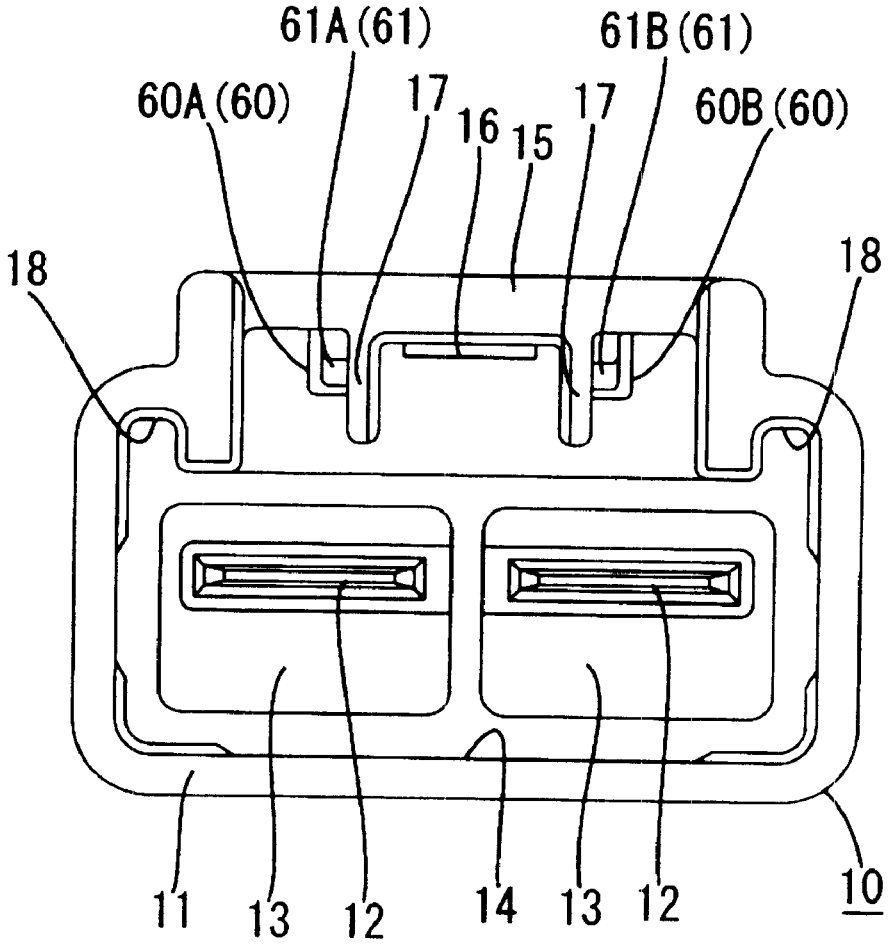
FIG. 4 is a front view showing a male housing.

The male housing 10 is provided with a generally tubular hood 11 that protrudes integrally forward from a device. Two generally tubular male terminals 12 protrude forward from a location inside the hood 11 and are spaced in a width-wise direction, as shown in FIGS. 3 and 4. The male terminals 12 can be connected with female terminals 21 of the female housing 20 when the female housing 20 is interfitted inside the hood 11 of the male housing 10. The interfitting face of male housing 10, includes a generally lattice-shaped concavely formed leak-preventive groove area 14. Two supporting areas 13 project forwardly from the concave leak-preventing groove area 14 and support the male terminals 12.

Figure 2:
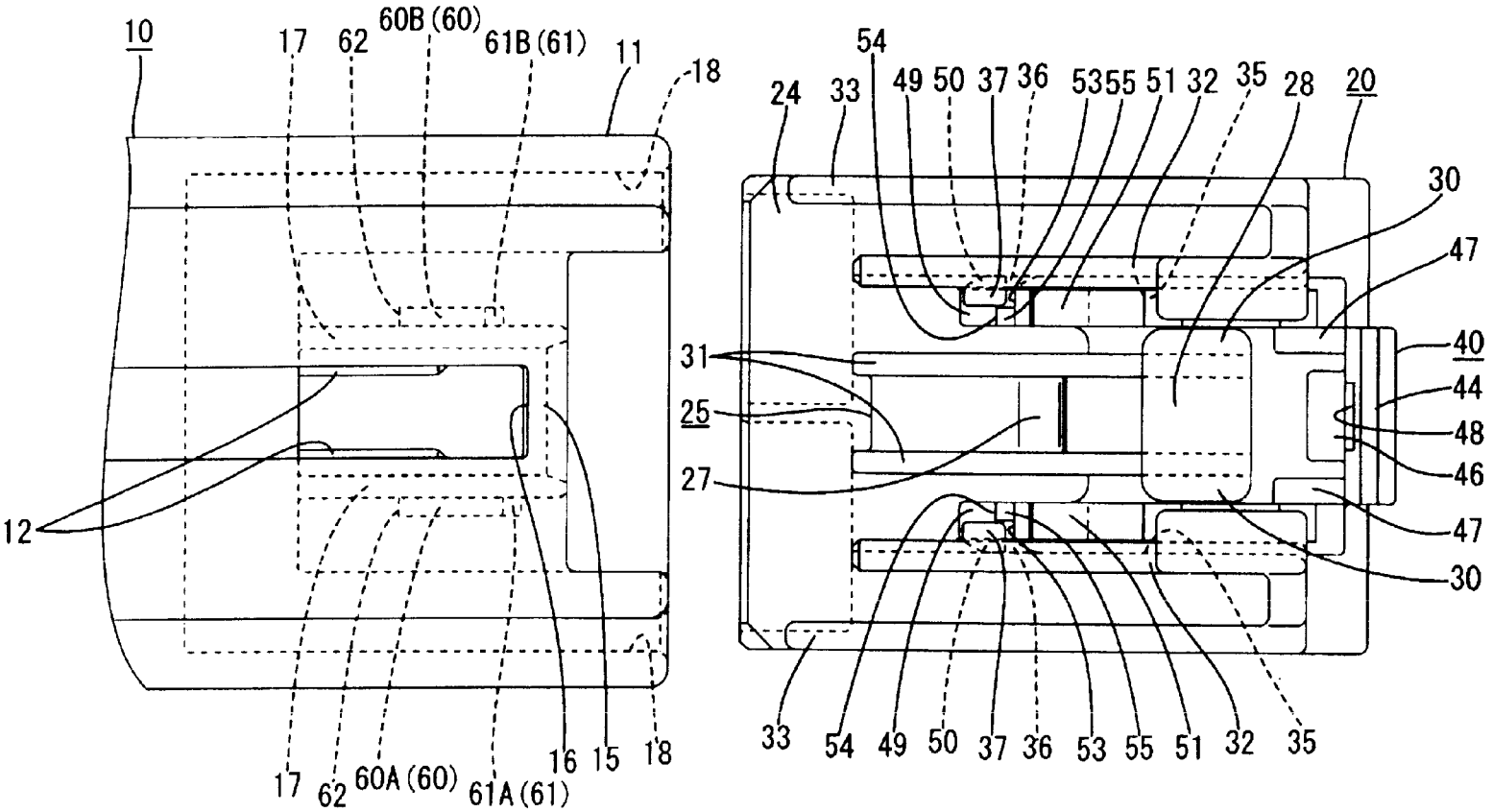
FIG. 2 is a plan view showing a condition in which both housings are separated from each other.

A lock hole 16 is formed on the central part in a width direction on the upper area in hood 11, as shown in FIGS. 2 and 3. The lock hole 16 opens rearward, leaving a front wall 15. A lock arm 25 on the female housing 20 is engageable on the front end face of the lock hole 16.

Guiding ribs 17 are formed on both sides of the lock hole 16 on the ceiling face of the hood 11. The guiding ribs 17 extend in a rail form along the back and forth or longitudinal direction, which is an interfitting direction of the housings 10 and 20, as shown in FIGS. 1–4. The guiding ribs 17 are spaced apart by a distance equal to or slightly greater than the width of lock arm 25 in the female housing 20. Thus, the interfitting of the housings 10 and 20 is guided by sliding the external faces of lock arm 25 along opposed faces of the guiding ribs 17. Furthermore, concave guiding areas 18 are formed on both sides of an upper part of the hood 11, as shown in FIG. 1.

Figure 14:
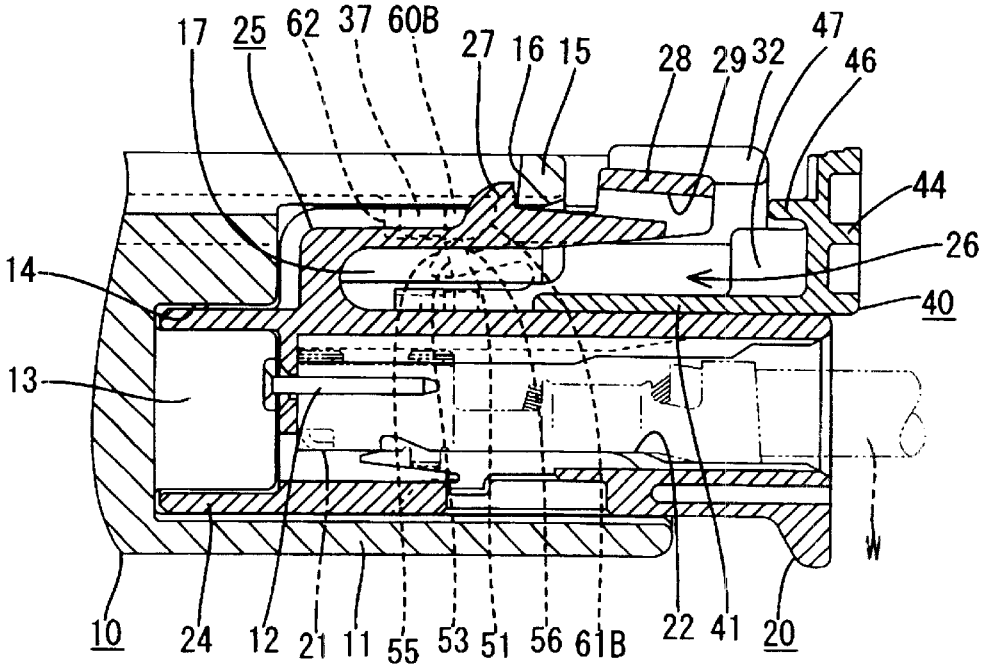
FIG. 14 is a sectional side view showing a condition in which a lock arm returns after the normal interfitting of both housings.

The hood 11 is formed in a partly cut-off manner so that only the upper front end face is retracted by a predetermined length. The back area of female housing 20 interfits with this cut-off area, as shown in FIG. 14.

Figure 5:
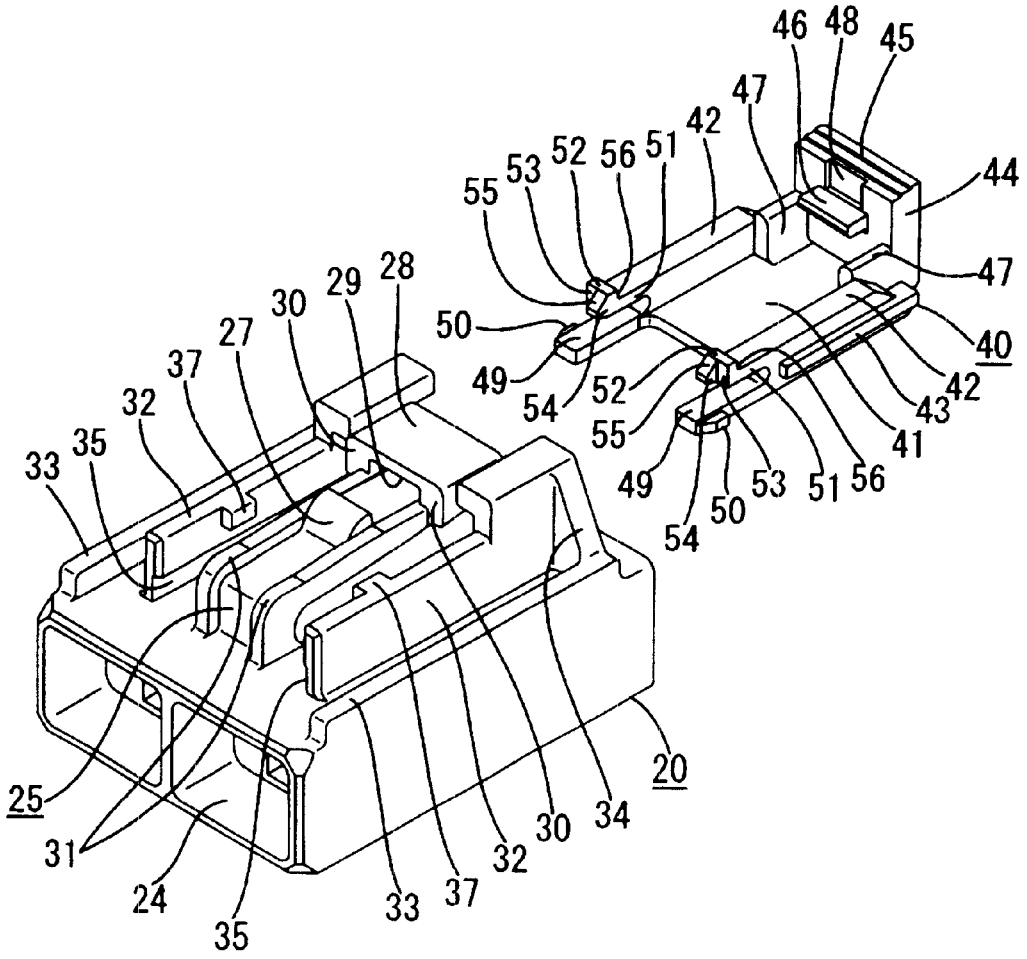
FIG. 5 is a perspective view showing a female housing and a detecting member.

As shown in FIG. 5, the female housing 20 is formed in a near-block shape. Two cavities 22 extend through the female housing 20 from the front to the back and are spaced apart in a width-wise direction. The cavities 22 are dimensioned and configured to accommodate metal female terminals 21 that have been connected with wires W. More particularly, the cavities 22 are configured to enable the terminals 21 to be inserted from the back of the female housing 20.

A cantilevered lance 23 is provided on the lower side of each cavity 22. The cantilevered lance 23 engages the female terminal 21 to prevent reward withdrawal of the fully inserted female terminal 21 from the cavity 22.

A near-lattice form leak-prevention cylinder area 24 protrudes forward from the front wall of the cavity 22, as shown in FIGS. 3 and 5. The leak-prevention cylinder area 24 can be interfitted inside the leak prevention groove area 14 of the male housing 10, as shown in FIG. 14, when the housings 10 and 20 are interfitted. Under this interfitting condition, adjacent male and female terminals 12 and 21 are partitioned off by the leak-prevention cylinder area 24.

Figure 6:
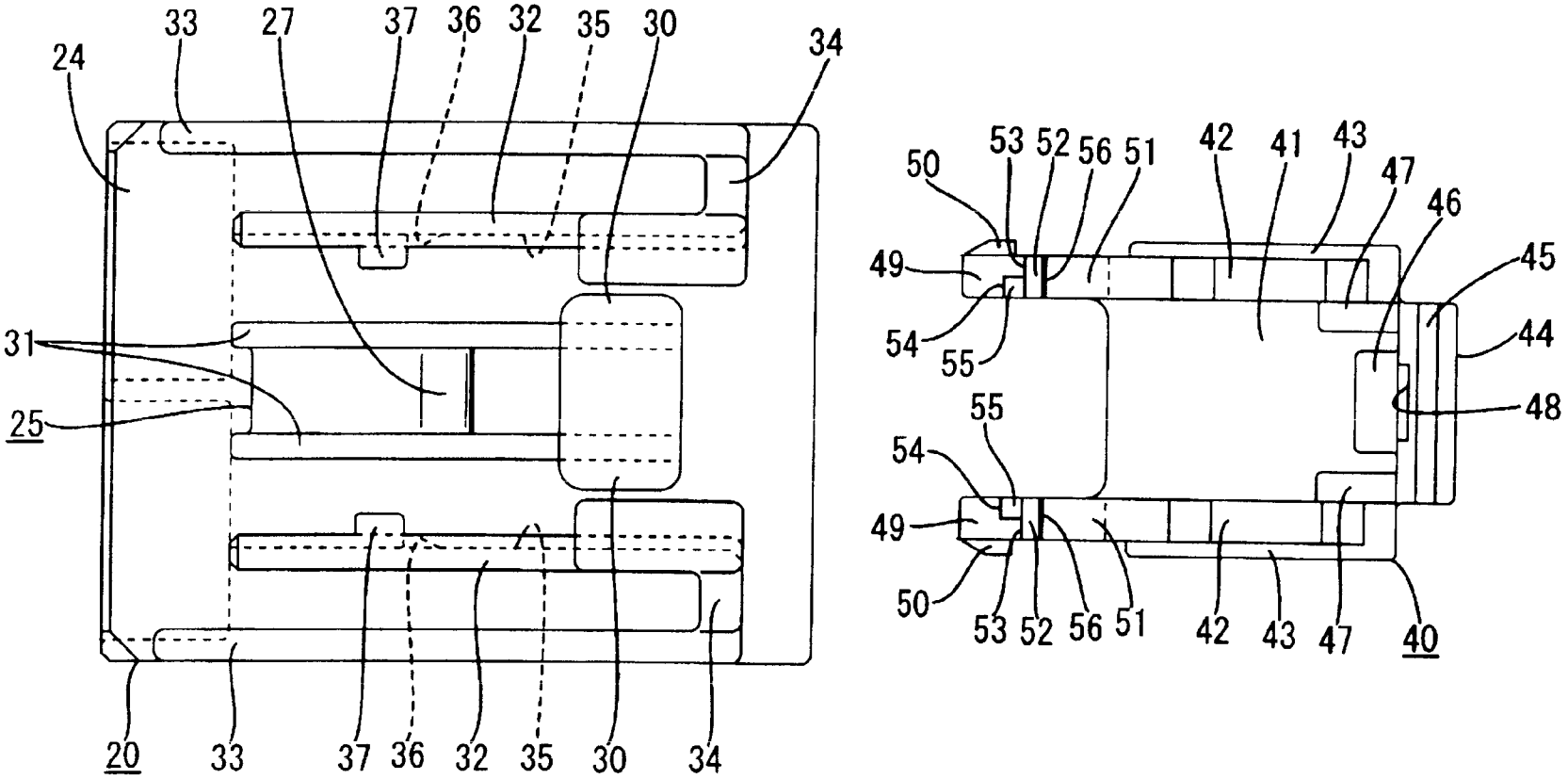
FIG. 6 is a plan view showing a female housing and a detecting member.

A lock arm 25 is cantilevered from the width-wise center of the upper face of female housing 20, as shown in FIGS. 5 and 6. The lock arm 25 has a base end that protrudes upwardly from the upper area of female housing 20 and an arm area that extends backward from the base end. The arm area is deflectively deformable along an up-and-down direction centering on the base end, as shown in FIG. 3. A deflection space 26 is formed below the lock arm 25 and accommodates a free-end of the arm area during the deflective deformation.

Figure 10:
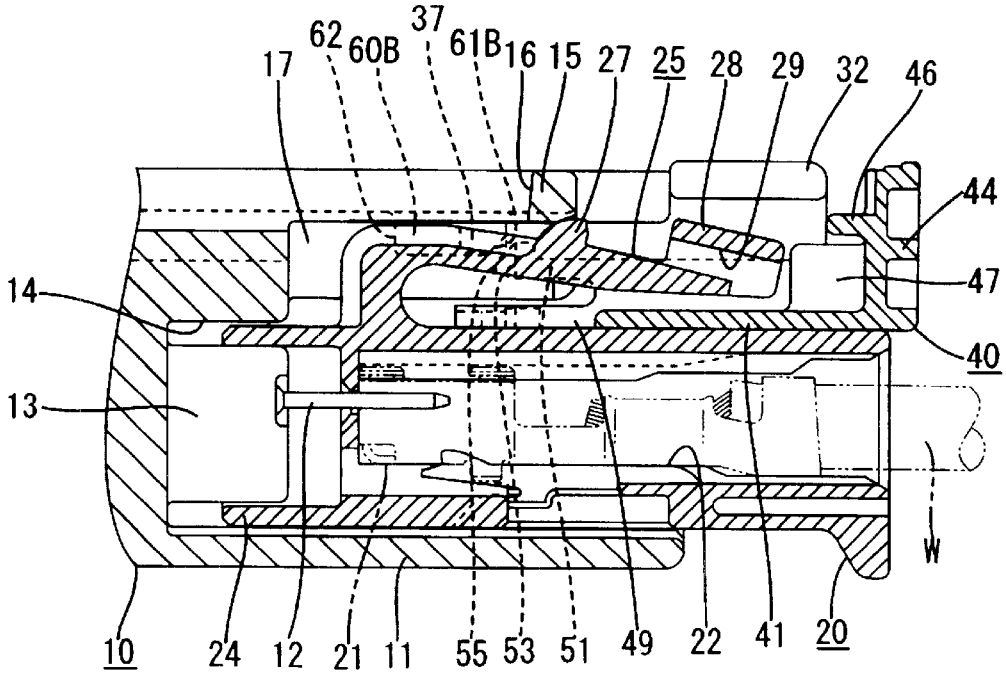
FIG. 10 is a sectional side view showing a condition in which a lock arm is deflected in the course of interfitting both housings.

A lock 27 protrudes near a longitudinally central part of the upper face of lock arm 25. The lock 27 enters into the lock hole 16 of the male housing 10 when both housings 10 and 20 come to a normal interfitting position, and the back end face of the lock 27 is engaged with the front end face of lock hole 16, as shown in FIG. 14. The back side of the lock arm 25 is higher than the front side of the lock 27. Thus, the lock arm 25 is held in a condition deflected slightly lower than the front wall 15 of lock hole 16 in a locked condition. The front end face of lock 27 is formed in a near-circular arc, and thus guides the deflective deformation of lock arm 25 in slidable contact with the front wall 15 of lock hole 16, as shown in FIG. 10.

A channel-type pressure operation area 28 protrudes from both side edges of the free-end on the upper face of lock arm 25, as shown in FIGS. 3 and 5. The lock arm 25 can be deflected by pressure on the pressure operation area 28 from the above.

A die cutting hole 29 penetrates from the back face side of pressure operation area 28 to the front side for die cutting the die when molding the lock 27. Overhang areas 30 overhang from right and left side faces of the pressure operation area 28, as shown in FIG. 6. Furthermore, reinforcing ribs 31 are formed on both edges in a width-wise direction on the upper face of lock arm 25, and extend over the full length of the lock arm 25. The reinforcing ribs 31 achieve a higher breaking strength for the lock arm 25. The reinforcing ribs 31 are formed in a rising shape towards the back over a predetermined region in the back and forth areas of the lock 27.

Protective walls 32 are formed on both sides of lock arm 25, as shown in FIGS. 5 and 6. The protective walls 32 are formed to cover almost all areas of the lock arm 25, as seen from the side view of FIG. 3.

The back end area of each protective wall 32 protrudes farther to the back than the back end of the lock arm 25, and is higher than a pressure operation area 28. Additionally, the upper back end area of the protective wall 32 is overhung towards the pressure operation area 28. The protective walls 32 prevent deformation of the lock arm 25 upward in a reversal direction, as could occur if a wire cable W entered into the deflected space 26 of the lock arm 25. Rail-form guide ribs 33 are formed on both sides on the upper face of female housing 20, and can enter into the concave guide areas 18 of male housing 10. The back end area is connected with the back end area of the protective wall 32 by a connection reinforcing area 34.

The detector 40 is mounted between both preventive walls 32 on the upper face of female housing 20. The detector 40 is equipped with a plane main body 41 that has almost the same width as the distance between the protective walls 32. The main body 41 is movable along an interfitting direction of the housings 10 and 20 when the main body 41 is mounted on the upper face of female housing 20. Guide rails 43 protrude laterally outward on both side edges of main body area 41. The guide rails 43 enter into the guide grooves 35 formed concavely on the lower side surface areas of the protective wall 32 and slidably contact with its periphery, thereby guiding the back and forth movement of detector 40.

An operation wall 44 protrudes upward on the back end of the main body 41 and an operation step area 45 rises stepwise from the top of the operation wall 44. The operation step area 45 of the operation wall 44 is pressed down to move the detector 40.

A planar deflection regulating wall 46 protrudes forward from a specified position on the operation wall 44 and is aligned parallel with the main body 41. The height of the deflection regulating wall 46, as shown in FIG. 14, is aligned with the die cutting hole 29 on lock arm 25 when the housings 10 and 20 come to a normal interfitting condition.

Detecting walls 47 extend between and connect each side wall 42 and the operation wall 44. The upper face of the detecting walls 47 are formed in a near-circular arc so as to match with the lower face of overhanging area 30 of lock arm 25, and is set at a position a little lower than the lower face of overhanging area 30 in a deflected condition of the lock arm 25 after normal overhanging of both housings 10 and 20. In addition, a concave take-off operation groove 48 is formed on the upper side of the deflection regulating wall 46 on the front face of the operation wall 44. The take-off operation groove 48 allows for insertion of a jig (not illustrated) for a removal operation.

Figure 16:
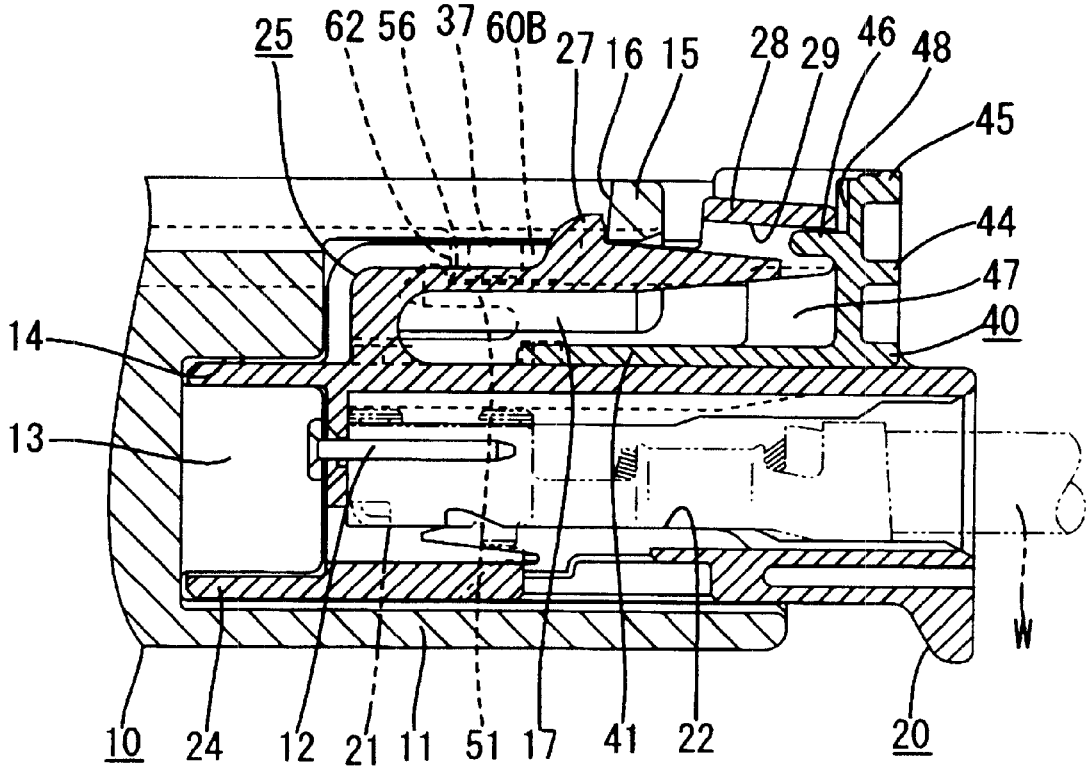
FIG. 16 is a sectional side view showing a condition in which a detecting member is moved to a detecting position.
Figure 17:
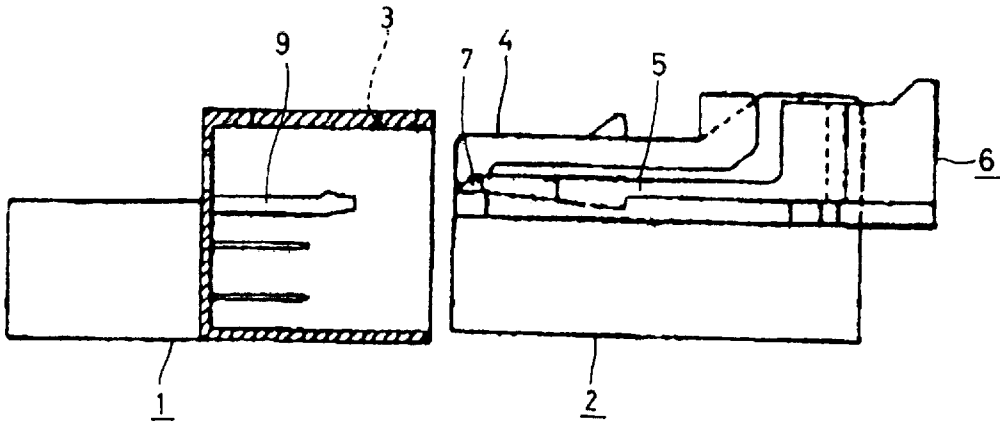
FIG. 17 PRIOR ART
FIG. 17 is a sectional side view showing a conventional connector.
Figure 18:
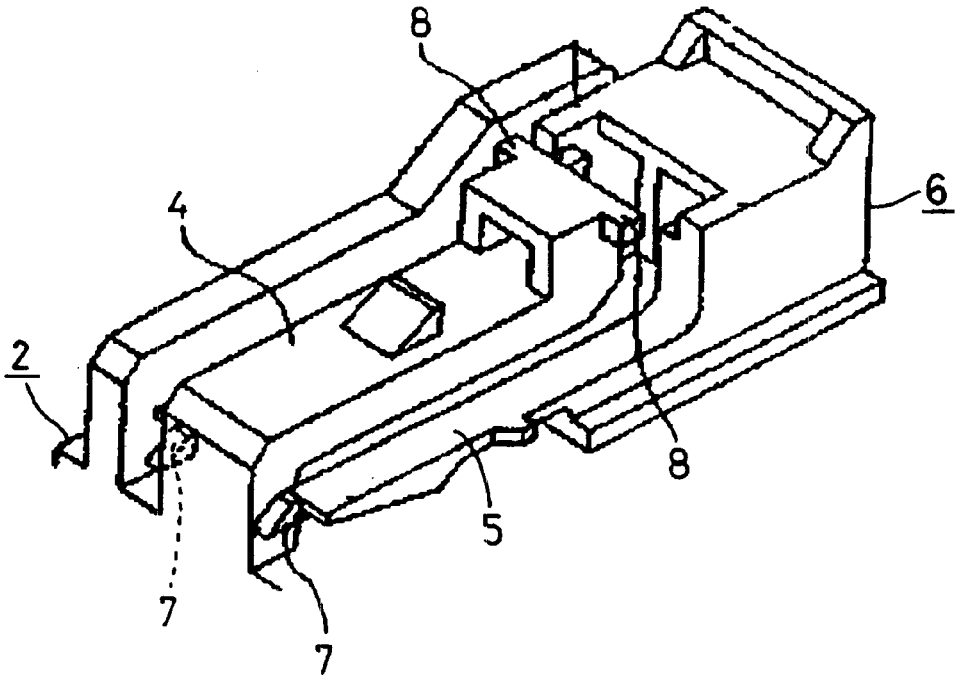
FIG. 18 PRIOR ART
FIG. 18 is a perspective view showing a conventional connector.

The detector 40 is made so that the back end area moves between a standby position (see FIG. 3) which protrudes rearwardly beyond the back end of female housing 20 and a detecting position (see FIG. 16) in which the back end face is flush with the back end face of the protective wall 32. When the detector 40 is in the standby position, as shown in FIG. 3, the detecting walls 47 are retracted backwards from the deflective space 26 of the lock arm 25, and do not interfere with the overhanging area 30. In this case, the deflection regulating wall 46 also is disposed in a position that is non-interfering with the lock arm 25. On the other hand, when the detector 40 is in the detecting position, as shown in FIG. 16, the detecting walls 47 enter into the deflective space 26 below the overhanging area 30 of lock arm 25, and are in a position that approaches or abuts the overhanging area 30.

In this instance, the deflection regulating wall 46 enters into the die cutting hole 29 of the lock arm 25, and engages in the back face of the pressure operation area 28, thereby making it impossible to deflect the lock arm 25.

Take-off preventive arms 49 project forward from both sides of the main body 41. The take-off preventive arms 49 are deflectively deformable along the upper face of female housing 20 so that both take-off preventive arms 49 approach each other. A take-off preventive protrusion 50 is formed on the side face at the front end area of each take-off preventive arm 49. The take-off preventive protrusions 50 are insertable into the guide grooves 35 of the protective wall 32.

The detector 40 is assembled from the back of female housing 20, and the take-off preventive protrusions 50 engage the stopper protrusion 36 provided on the way to the guide groove 35 (see FIG. 6). The take-off preventive arms 49 are deformed by these engagements, and the detector 40 reaches a standby position, as shown in FIG. 2. The take-off preventive arms 49 then return, and the back end face of the take-off preventive protrusions 50 engage with the front end faces of the respective stopper protrusions 36. Thus, movement of the detector 40 towards the back from the standby position is regulated.

Engaging arms 51 extend forward from the front end upper areas of both side walls 42, as shown in FIG. 5. The engaging arms 51 are formed in a hook shape, and are provided with a jaw area 52 that protrudes upwards on the front end. The engaging arms 51 are formed with almost the same width as the take-off preventive arms 49, and the front end of each engaging arm 51 is retracted backwards from the take-off preventive arm 49.

The engaging arms 51 are spaced above the take-off preventive arms 49. Thus a downward deflective deformation of the engaging arms 51 is made possible. The engaging arms 51 are in positions adjacent the protecting walls 32 when the detector 40 is assembled to the stand by position against female housing 20, and its front engaging face 53 is engaged with an engaging protrusion 37 that is protruded inwards from the inner face of protection wall 32. By this means, the movement of the detector 40 from the standby position to the forward detecting position is regulated.

A predetermined clearance is assured between the front end face of each engaging arm 51 and the back end face of the corresponding engaging protrusion 37 when the detector 40 is in the standby position. Thus, interference of the front end face with the engaging protrusion 37 can be avoided when the engaging arm 51 is deflected downwards.

The engaging protrusion 37 has a protruded width of almost the half of the width of engaging arm 51, and the engaging face 53 for engaging the protrusion area is about the half of outside dimension of the front end face of the corresponding engaging arm 51. On the other hand, an engaging protrusion 54 protrudes forward at the inner area of the engaging face 53 in the front end face of the engaging arm 51. A tapered engaging face 55 is inclined upward at the upper area in the front face. A clearance of a predetermined width is defined between the engaging arm 51 and the lock arm 25. The guiding rib 17 on the male housing 10 can enter the clearance during the interfitting of both housings 10 and 20.

Releasing ribs 60 project down from the ceiling of the hood 11 in the male housing 10, as shown in FIGS. 2 and 4, and are adjacent to and outside of the guiding ribs 17. The releasing ribs 60 extend back and forth over a predetermined length along an interfitting direction of both housings 10 and 20 and are retracted backwards from the front end of the guiding rib 17.

The entire tops of the releasing ribs 60 are connected with the ceiling of hood 11 along an interfitting direction of both housings 10 and 20, as shown in FIG. 3, and the entire inner sides of the releasing ribs 60 are connected with the outside faces of the guiding ribs 17, as shown in FIG. 3. That is, the upper and inner faces of the releasing ribs 60 that intersect each other are integrally connected with the male housing 10, thereby gaining a sufficiently high strength. As shown in FIG. 3, the lower faces of the releasing ribs 60 are slightly lower than the lower faces of the engaging protrusive walls 37 of the female housing 20. In addition, the lower faces of releasing rib 60 are higher than the lower faces of the guiding ribs 17, thereby allowing the releasing ribs 60 to completely overlap with the respective guiding ribs 17 when seen from the side.

The width of the releasing rib 60 is almost the same as the width of the engaging protrusion 54 on the engaging arm 51 of the detecting member 40. With both housings 10 and 20 interfitted, the guiding ribs 17 enter into the clearances between the lock arm 25 and the engaging arms 51, and the releasing ribs 60 on the outside of the guiding ribs 17 are engaged with engaging protrusions 54 of the respective engaging arms 51. The lower area of the front end face of each releasing rib 60 has a tapered engaging face 61 inclined downward at almost the same angle of inclination as the engaging face 55 on the engaging protrusion 54. Thus, both engaging faces 55 and 61 abut, and the engaging arm 51 is guided to deflect downward. The upper face of engaging arm 51 deflects sufficiently to abut the lower face of releasing rib 60. Therefore, the engaging condition between the engaging arm 51 and the engaging protrusion 37 is completely released (See FIG. 11). On the other hand, when the detector 40 is moved from a standby position to a detecting position, the jaw area 52 of each engaging arm 51 reaches the space at the back of the respective releasing rib 60 followed by an elastic return of the respective engaging arm 51. Hence, the back end face 56 of the jaw 52 is engaged with a hook 62 at the back end face of the releasing rib 60 (See FIG. 15). With this means, the detector 40 is regulated to move to the standby position on the back from the detecting position. In this case, however, since the back end face 56 of jaw area 52 is formed in a gradual taper-form, the engaging condition between the back end face 56 of the jaw 52 and the hook 62 is released when a backward force of more than the predetermined value acts on the detector 40, a so-called semi-lock being applied.

Both the releasing ribs 60 are formed with the positions of front end face and engaging face 61 shifted back and forth from each other in an interfitting direction. More particularly, an engaging face 61A of a releasing rib 60A on the front side as shown in FIG. 2 is disposed in a position near the front, while an engaging face 61B of the releasing rib 60B is disposed in a position nearer the back.

The timing that both releasing ribs 60A and 60B deflect the respective engaging arms 51 is carried out such that the front side releasing rib 60A first engages with the corresponding engaging arm 51. The engaging arm 51 then is deflected to a position at which the engaging protrusion 37 is completely released from the engaging face 53 followed by the release of the engaging condition (a position at which the upper face of engaging arm 51 abuts on the lower face of releasing rib 60A). The releasing rib 60B at the back then is engaged with the engaging arm 51 (see FIG. 9). The hooks 62 (back end faces) of both releasing ribs 60A and 60B are aligned at the same position, and both the engaging arms 51 return at the same time when the detector 40 comes to a detecting position. That is, the releasing rib 60A is longer than the releasing rib 60B.

Figure 7:
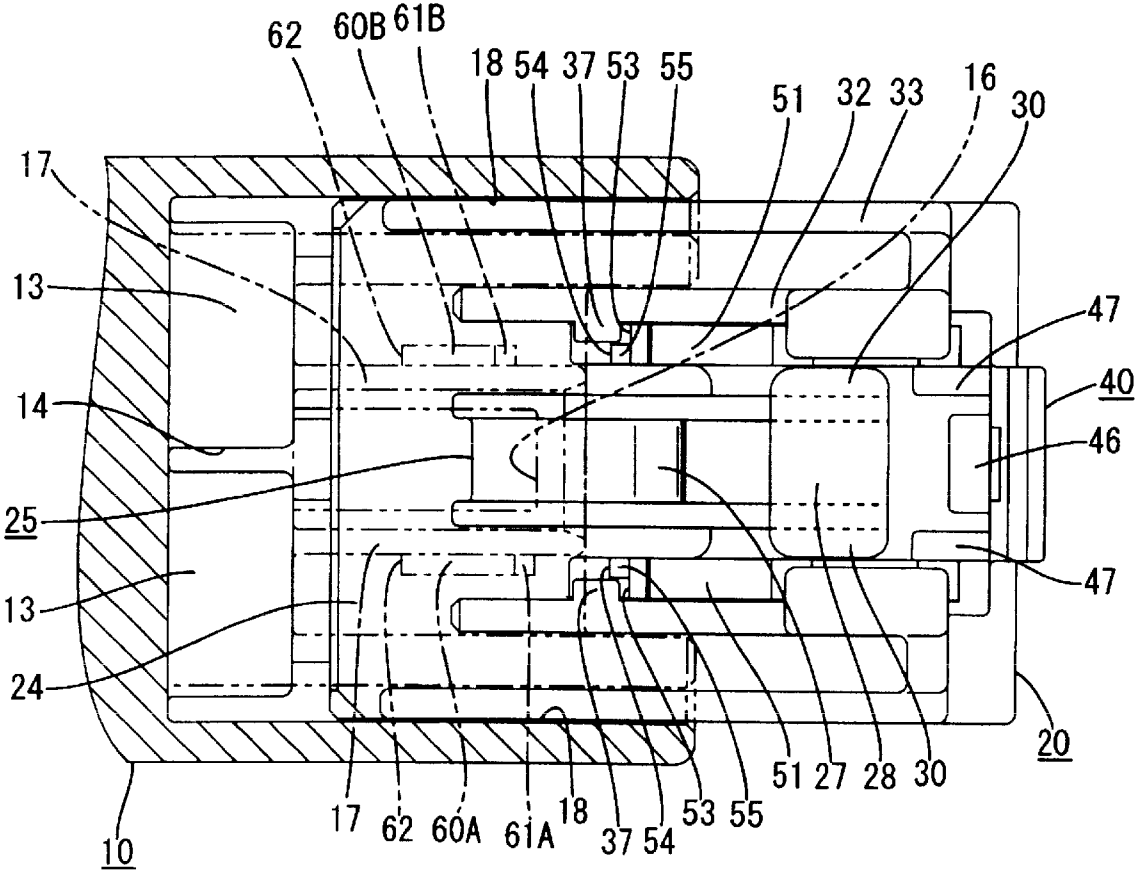
FIG. 7 is a sectional plan view showing an initial condition in which both housings are interfitted.

As shown in FIGS. 2 and 3, both male and female housings 10 and 20 are interfitted under the condition that the detector 40 is mounted at a standby position on the female housing 20. The female housing 20 then enters into the hood 11 of male housing 10. As a result, the guide ribs 33 enter into the guiding concave areas 18 as shown in FIG. 7 and the guiding ribs 17 enter into the clearances between the lock arm 25 and the engaging arms 51 followed by sliding contact by each peripheral face. Thus, the housings 10 and 20 can perform smooth interfitting without wiggling in a width direction.

Figure 8:
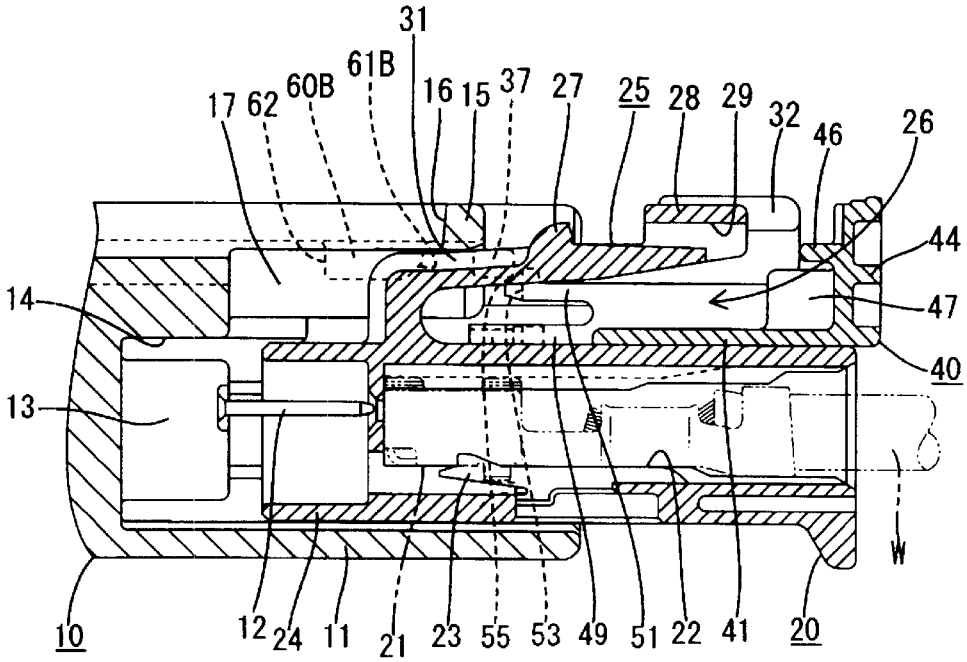
FIG. 8 is a sectional side view showing an initial condition in which both housings are interfitted.

As shown in FIG. 8, the lock arm 25 deflects downward beginning from a step immediately before the male terminals 12 make contact with the female terminals 21 to the completion of gradual deflection of the lock arm 25 made by the front wall 15 of the lock hole 16 that abuts the reinforcing ribs 31 of lock arm 25, followed by abutting on the front end face of lock 27. At this point, the overhang area 30 deflects into the deflective space 26, and is disposed in a position that allows interference with the detecting walls 47 of the detector 40.

In addition, the leak-prevention cylinders 24 enters into a leak-detection groove areas 14.

Figure 9:
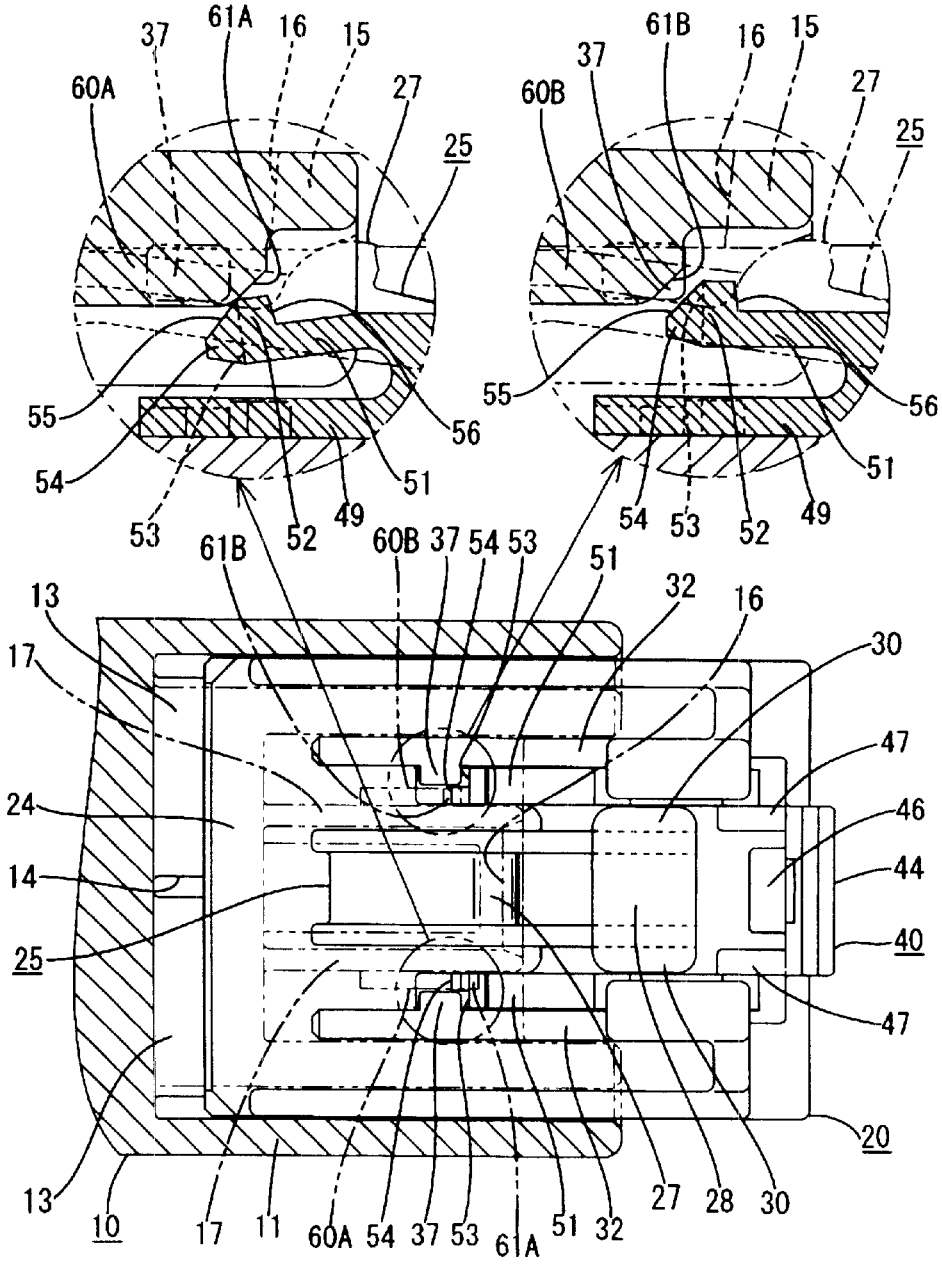
FIG. 9 is a sectional plan view showing an intermediate condition in which both housings are interfitted, and a sectional side view at this occasion showing a relationship between both releasing ribs and an engaging arm.

At this point, as shown in FIG. 9, the engaging face 61A of the releasing rib 60A at a front side engages with the engaging face 55 of the engaging protrusion 54 on the engaging arm 51, and, as a result, the engaging arm 51 deflects downward. The engaging arm 51 deforms downward until the upper face of the engaging arm 51 abuts the lower face of the releasing rib 60A. At this stage, the engaging face 53 is disengaged from the engaging protrusive area 37, thereby the engaging condition is released.

On the other hand, the releasing rib 60B at the back side has not yet interfered with the engaging arm 51, even when the detecting member 40 is pushed forwards under this condition. Therefore, the moving action is regulated by an engagement to be made between the engaging arm 51 at the backside and the engaging protrusion area 37.

Figure 11:
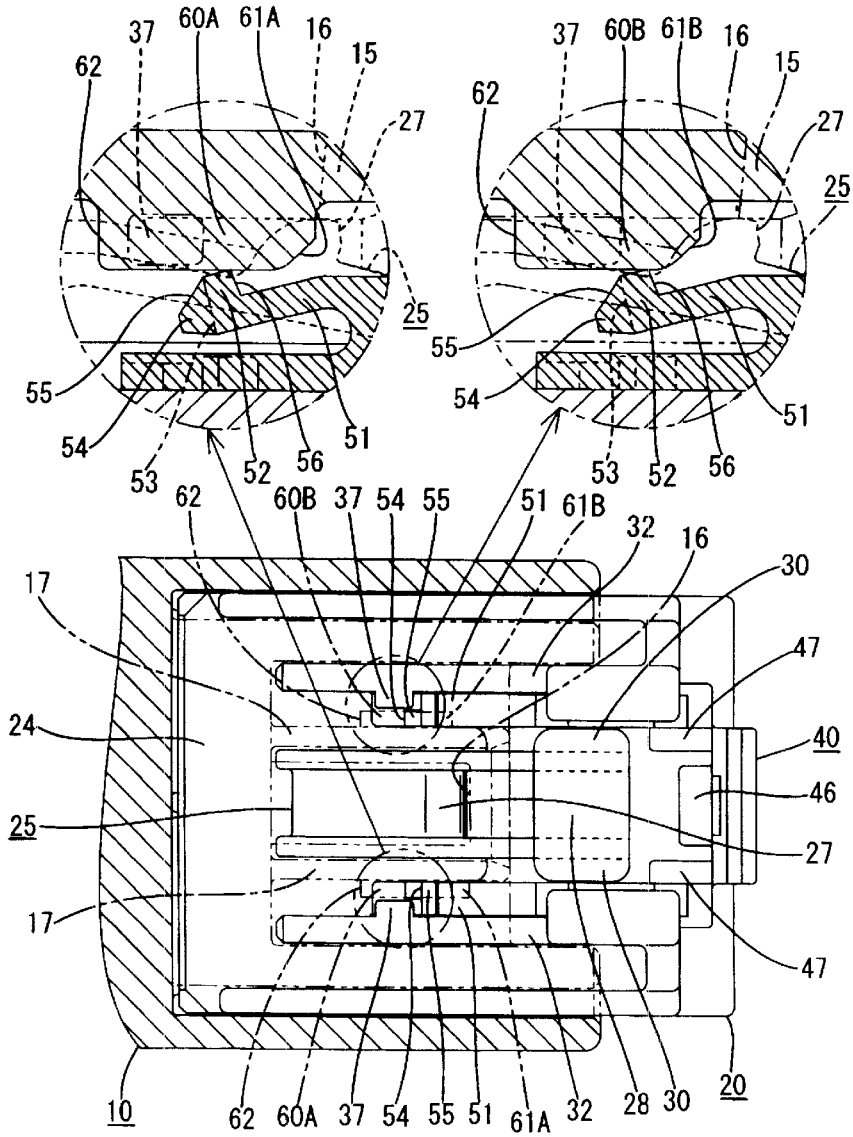
FIG. 11 is a sectional plan view showing a condition immediately before both housings come into a normal interfitting condition, and a sectional side view at this occasion showing a relationship between both releasing ribs and engaging arm.
Figure 12:
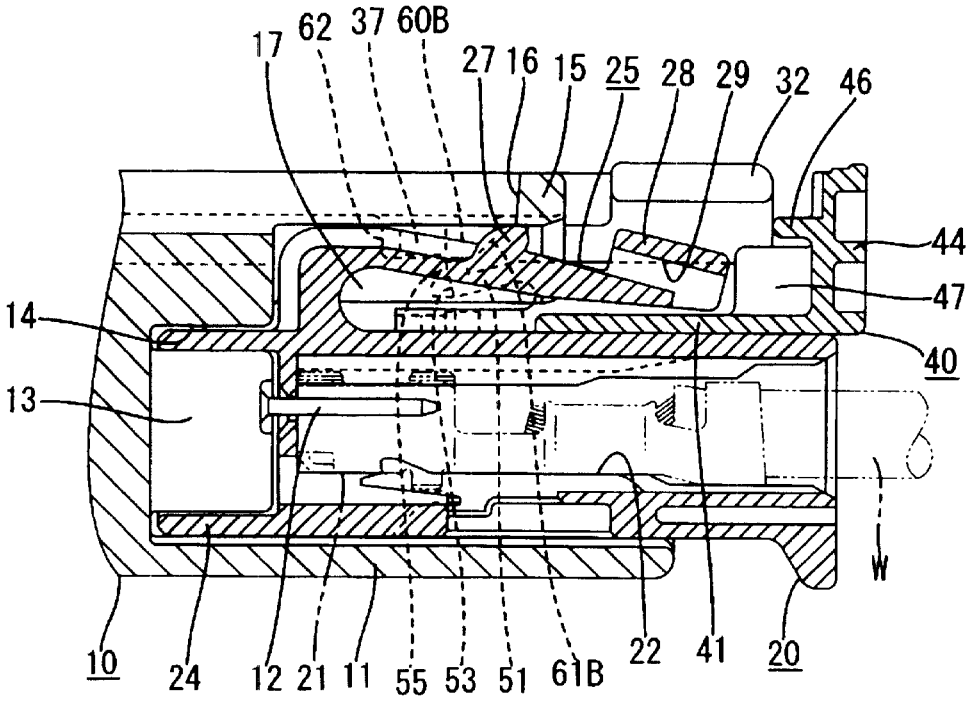
FIG. 12 is a sectional side view showing a condition immediately before both housings come into a normal interfitting condition.

With the interfitting further advanced, the engaging face 61B of the releasing rib 60B in the back side deflects the engaging arm 51 by engaging with the engaging face 55 of the engaging protrusion 54. As shown in FIG. 11, when the housings 10 and 20 come to a stage immediately before reaching a normal or complete interfitting, the engaging face 53 of the engaging arm 51 is deflected by the releasing rib 60B to a completely released position from the engaging protrusion 37, and then the engaging position is released. At this stage, the movement regulation condition of the detector 40 by the engaging arm 51 and engaging protrusion 37 is released. However, even if the detector 40 is pushed forwards at this stage, as shown in FIG. 12, interfering by an overhanging area 30 which entered into a deflective space 26 regulates movement of the detector 40. In this way, the inability to move the detector 40 forward proves that the housings 10 and 20 are still on the way to interfitting.

Figure 13:
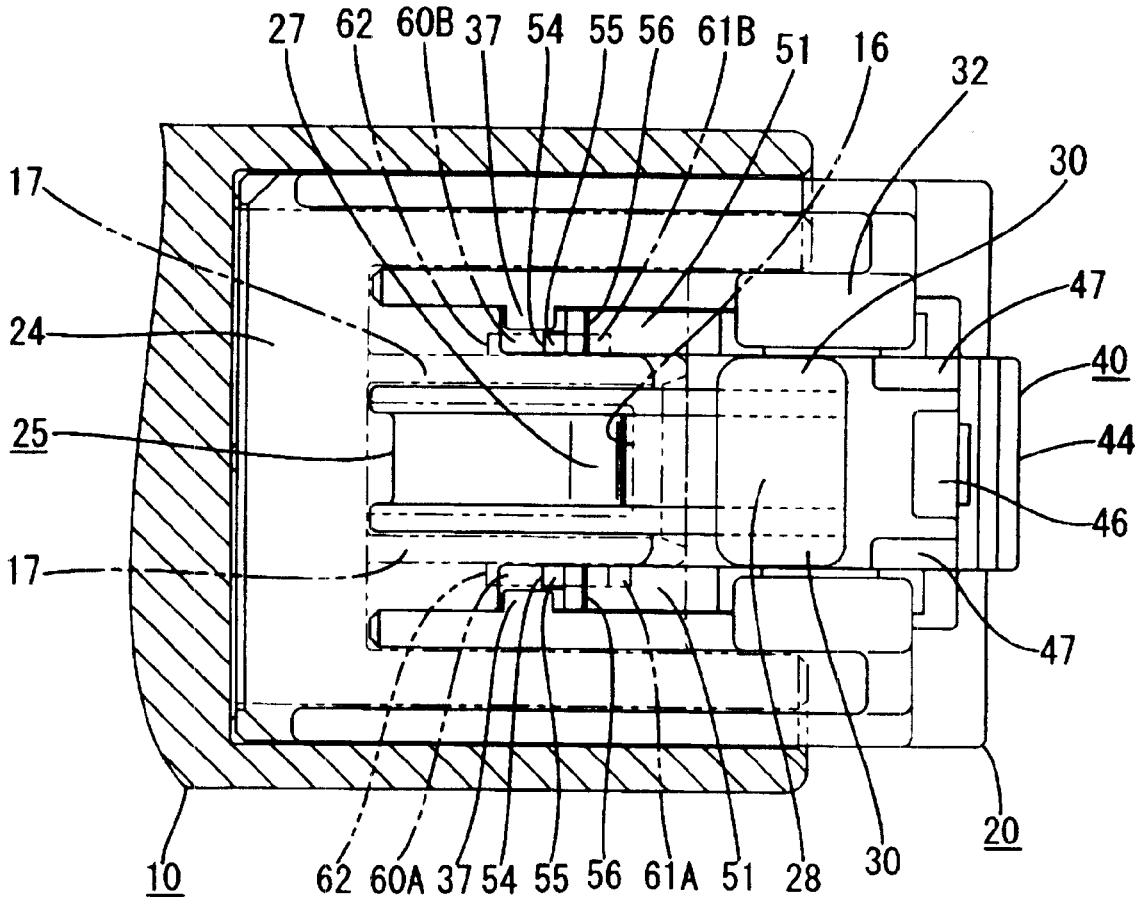
FIG. 13 is a sectional plan view showing a condition in which both buildings come into a normal interfitting condition.

When the housings 10 and 20 come to a normally interfitting condition, as shown in FIGS. 13 and 14, the terminals 12 and 21 reach the normal connection condition. Additionally, the lock 27 enters the lock hole 16 after the elastic return of the lock arm 25, and the back end face of the lock 27 is engaged with the front end face of lock hole 16. Thus, the housings 10 and 20 are held disengageable from the normal interfitting condition. A collided noise is generated from the collision between the front wall 15 of lock hole 16 and the upper face of lock arm 25. Consequently, the operator can easily sense the completion of normal interfitting of both housings 10 and 20. In this case, lock arm 25 does not return to a natural condition, but is kept rather in a deflected posture.

Under this condition, the die cutting hole 29 is aligned with the deflection regulated wall 46 of the detecting member 40, and the lower face of the overhanging area 30 is positioned at a slightly higher position than the upper face of the detecting wall 47.

In addition, when at a normal interfitting, the leak-preventive cylinder area 24 is interfitted in the leak preventive groove area 14, and is disposed to surround the supportive area 13.

Figure 15:
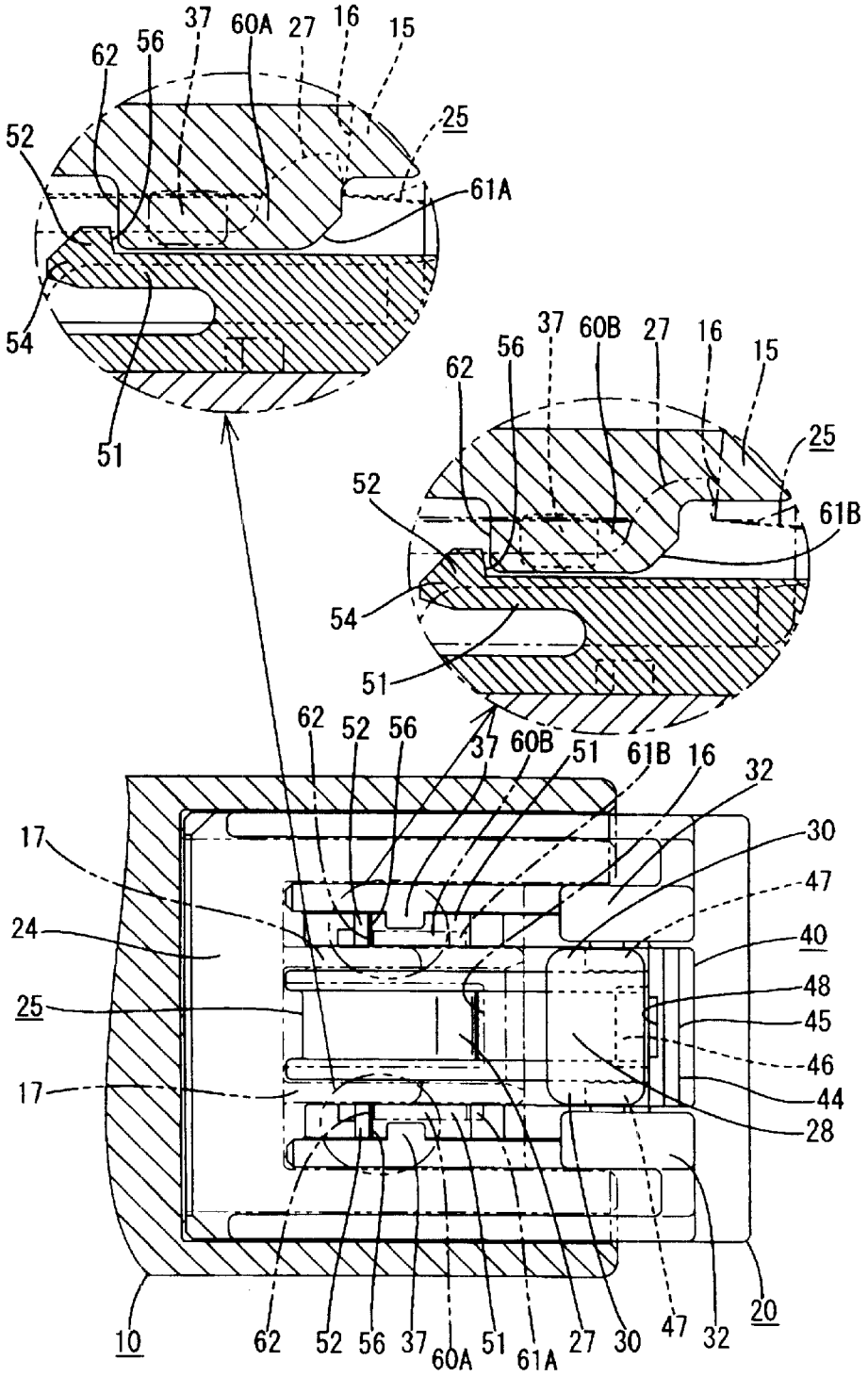
FIG. 15 is a sectional plan view showing a condition in which a detecting member is moved to a detecting position, and a sectional side view at this occasion showing a relationship between both releasing ribs and engaging arm.

When the housings 10 and 20 push the detector 40 into a detecting position at a normal interfitting condition, the detector 40 advances along the upper face of the female housing 20 with the guide rails 43 being in sliding contact with the peripheral faces of guiding grooves 35. In this process, the upper faces of the respective engaging arms 51 are in a deflective condition and are in sliding contact with the lower faces of the releasing ribs 60. When the detector 40 reaches the detecting position, as shown in FIG. 15, the jaws 52 of both engaging arms 51 reach the backward spaces of the respective releasing ribs 60. Thus, the engaging arms 51 elastically return at the same time, and the back end faces 56 of the jaws 52 engage with the hook faces 62 of the releasing ribs 60. In this way, the detector 40 is regulated to move backwards from the detecting position, and is held in a semi-lock condition in the detecting position. Additionally, as shown in FIG. 16, the deflection regulating wall 46 enters the die cutting hole 29 of the lock arm 25 and engages with the back face side of pushing pressure operation area 28.

With this effect, downward forces on the lock arm 25 will not cause deflection of the lock arm 25 while the housings 10 and 20 are in a normal interfitting condition. However, as shown in FIG. 15, the detecting walls 47 engage on the lower faces of overhanging areas 30. Therefore, an erroneous deflection of the lock arm 25 can even be regulated by the detecting walls 47 disposed on both side positions, and by the aforementioned deflection-regulating wall 46. In other words, the lock arm 25 is supported at three positions aligned in a width-wise direction, and can positively achieve its erroneous deflection prevention.

Dew condensation water may generate inside the space when the housings 10 and 20 are in the normal interfitting condition of FIG. 16. Even in such a case, partitioning the adjacent male and female terminal metals 12 and 21 by a leak preventive cylinder area 24 can reserve a creepage distance from the front side cavity 22 to- the back side cavity 22 by more than two times the length of the leak preventive cylinder area 24, thereby preventing the adjacent male and female terminals 12 and 21 from being subjected to leakage of dew condensation water.

The housings 10 and 20 can be separated by using a jig (that is not shown here). The jig can be inserted into the operation groove 48 for taking off the detector 40. More particularly, the detector 40 can moved backwards from the detecting position after the engaging arm 51 is deflected by the jig from the semi-lock condition in which the back end face 56 and the hooking face 62 of the jaw 52 are engaged into a condition where the engagement is released.

In this case, the releasing work may be carried out by pressing down the operation step area 45 with a finger instead of using the jig as aforementioned. After the semi-lock condition is released, the pressing operation at the operation step area 45 can retract the detector 40 to the standby position (see FIG. 14). As a result, the deflection regulating wall 46 retracts from the die cutting hole 29, the detecting walls 47 retract from the overhanging areas 30 and the deflective space 26 is opened. The housings 10 and 20 are set apart with the lock arm 25 being deflected and deformed by a press operation at the press operation area 28 of lock arm 25 and the locked condition between the housings 10 and 20 is released.

As described above, the releasing rib 60 can have a high strength because its upper face is connected with the ceiling face of hood 11. Thus, the releasing rib 60 will not be deflected or damaged even if a foreign object entering into the hood 11 interferes with the releasing rib 60.

Moreover, the strength of each releasing rib 60 is enhanced because its inner face is connected with the outer face of the respective guiding rib 17.

In addition, the releasing rib 60A is at the front position and the releasing rib 60B is at the rearward position. More particularly, the engaging faces 61A and 61B that engage with the respective engaging arms 51 are displaced back and forth in an interfitting direction of both the housings 10 and 20. As a result, timing can be shifted for deflecting the engaging arm 51 at the front side and the back side in the interfitting process. Thus, a situation in which forces applied to both housings 10 and 20 become abruptly greater can be prevented, thereby smoothly carrying out the interfitting work on both housings 10 and 20.

The present invention is not restricted to the embodiment as mentioned in the aforementioned description and drawings, but also includes, for instance, the following embodiments within a technical scope of the present invention. Furthermore, embodiments with various modifications or alterations can be implemented within a scope that does not deviate from the essence other than the ones mentioned below.

With the illustrated embodiment, the engaging faces of the releasing ribs are shifted back and forth. Alternatively, however, the engaging faces in the engaging arms may be shifted back and forth.

For example, the position of the engaging face can be shifted back and forth by changing a protrusive dimension of the engaging protrusion at both engaging arms.

Contrary to the aforementioned case, the engaging faces of both releasing ribs can be aligned for deflecting both engaging arms at the same time.

In the embodiment described above, the timing in which a releasing rib in the back side deflects the engaging arm was shown for the occasion immediately before the housings are normally interfitted. But, this timing may be fixed at the same time as the occasion of normal interfitting, and such a case is also included in the present invention.

In the embodiment as described above, the releasing rib is disposed at a position adjacent to the outside of the guiding rib. However, the releasing rib can be set regardless of the position adjacent to the guiding rib. Furthermore, the housing on which a guiding rib is not provided also is included in the present invention.

What is claimed is:

1. A connector, comprising;

first and second connector housings configured for mutual interfitting, a lock arm formed on the second connector housing and configured for elastic deformation into a deflective space during the interfitting of the connector housings, the lock arm elastically returning toward an undeflected condition for engaging with the first connector housing and for maintaining the first and second connector housings in the interfitting condition, a detector being mounted on the second connector housing for restraining deflection of the lock arm into the deflective space; two deflective engaging arms being provided on the detector and being engageable respectively with two engaging areas on the second connector housing for restraining movement of the detector relative to the second connector housing during the interfitting of the connector housings, two releasing areas formed on the first connector housing that defectively deform the engaging arms to release the engaging arms from the engaging areas when the connector housings are interfitted, the releasing area extending along an interfitting direction of the connector housings and being connected with the first connector housing along the interfitting direction, at least one of the engaging arms and the releasing areas being offset along the interfitting direction to achieve a time difference in which the engaging arms are released from the engaging areas during interfitting of the connector housings.

2. A connector as set forth in claim 1, wherein, two guiding ribs provided on the first connector housing for a guiding sliding contact with the second connector housing during interfitting of the connector housings along the interfitting direction, the releasing areas being connected with the guiding ribs along the interfitting direction.

3. A connector comprising:

a first connector housing having a locking wall formed thereon;

a second connector housing moveable from an unconnected condition to a fully connected condition relative to the first connector housing, a resiliently deflectable lock arm formed on the second connector housing, the lock arm being configured for engagement with the locking wall on the first connector housing when the first and second connector housings are in the fully connected condition, two engaging areas formed on the second connector housing;

a detector slidably mounted on the second connector housing for movement from a standby position to a detecting position, the detector comprising two resiliently deflectable engaging arms disposed for engagement with the engaging areas of the second connector housing for preventing movement of the detector from the standby position to the detecting position; and two releasing areas formed unitarily with the first connector housing at a position on the first connector housing for engaging the engaging arms when the first and second connector housings reach the fully connected condition, the releasing areas being configured for deflecting the engaging arms out of engagement with the engaging areas and thereby permitting the detector to move to the detecting position, the releasing areas and the engaging arms being configured for deflecting the engaging arms sequentially during movement of the first and second connector housings to the fully connected condition.

4. The connector of claim 3, wherein a first of the releasing areas is longer than a second of the releasing areas, such that the first releasing area engages a corresponding one of the engaging arms before the second of the releasing areas engages its respective engaging arm.

5. The connector of claim 3, wherein the engaging arm is configured for locked engagement with the releasing area when the detector is in the detecting position.

6. The connector of claim 3, wherein the detector comprises means for preventing deflection of the lock arm when the detector is in the detecting position.

7. The connector of claim 3, wherein the second connector housing comprises a front end for connection with first connector housing and an opposite rear end, the detector projecting rearwardly beyond the rear end of the second connector housing when the detector is in the standby position, and being substantially flush with the rear end of the second connector housing when the detector is in the detecting position.

8. A connector comprising:

a first connector housing having a hood with a locking aperture defining a locking wall on the hood, first and second guiding ribs extending into the hood, first and second releasing areas protruding respectively from the respective guiding ribs;

a second connector housing moveable from an unconnected condition to a fully connected condition in the hood of the first connector housing, a resiliently deflectable lock arm formed on the second connector housing, the lock arm being configured for engagement with the locking wall on the first connector housing when the first and second connector housings are in the fully connected condition, first and second engaging areas formed on the second connector housing;

a detector slidably mounted on the second connector housing for movement from a standby position to a detecting position, the detector comprising first and second resiliently deflectable engaging arms disposed for engagement respectively with the first and second engaging areas of the second connector housing for preventing movement of the detector from the standby position to the detecting position, the engaging arms being configured for engaging the respective first and second releasing areas when the first and second connector housings reach the fully connected condition, the releasing areas being configured for deflecting the engaging arms out of engagement with the engaging areas and thereby permitting the detector to move to the detecting position, wherein the releasing areas and the engaging arms are configured for deflecting the engaging arms sequentially during movement of the first and second connector housings to the fully connected condition.

9. The connector of claim 8, wherein the first releasing area is longer than the second releasing area, such that the first releasing area engages the first engaging arm before the second releasing area engages the second engaging arm.

10. The connector of claim 8, wherein the engaging arms are configured for locked engagement with the releasing areas when the detector is in the detecting position.

11. The connector of claim 8, wherein the detector comprises means for preventing deflection of the lock arm when the detector is in the detecting position.

* * * * *